US005104094A

United States Patent [19]

Womack

[11] Patent Number: 5,104,094

[45] Date of Patent: Apr. 14, 1992

[54] CAR DOOR LATCH MECHANISM VIEWING TOOL

[76] Inventor: Robert C. Womack, 5119 Radbrook Pl., Dallas, Tex. 75220

[21] Appl. No.: 663,118

[22] Filed: Mar. 1, 1991

[51] Int. Cl.[5] ..... B66F 00/00

[52] U.S. Cl. ..... 254/104; 29/239; 81/488; 81/15.9; 70/465

[58] Field of Search ..... 29/235, 239, 238, 243.5, 29/270; 254/104; 81/488, 15.9; 7/169; 70/465, 394

[56] References Cited

U.S. PATENT DOCUMENTS

| | | | |
|---|---|---|---|
| 4,713,922 | 12/1987 | Ingold | 254/104 |
| 4,752,173 | 6/1988 | Fleming | 269/905 |
| 4,788,893 | 12/1988 | Sutton | 81/15.9 |
| 4,836,061 | 6/1989 | Weinraub | 81/15.9 |

*Primary Examiner*—Bruce M. Kisliuk
*Assistant Examiner*—Eileen P. Morgan
*Attorney, Agent, or Firm*—Warren H. Kintzinger

[57] ABSTRACT

A relatively thin bend formed shim tool formed of sheet metal, or plastic, is provided to help a locksmith view and have access to lock release mechanism of a locked vehicle door from the outside when the vehicle door key is lost, or left inside the vehicle. The tool insert sheet portion is inserted downwardly between the outer surface of the door window glass and the outer window sill rubber seal to hold the rubber seal deflected back out of the way when two wedges are pushed down between the door window glass and the tool insert sheet at opposite ends thereof. The tool has a curved back bottom edge at the lower edge of the insert sheet portion that depends from a rounded top that spans a portion of the door outer sill rubber seal to an outer diverging outward sheet continuation to a further outwardly extended handle. The outer diverging outward sheet continuation of the tool and the outwardly extended handle are both undercoated with a layer of felt bonded by glue or plastic to the undersides thereof to protect the paint finish of the vehicle door.

19 Claims, 3 Drawing Sheets

CAR DOOR LATCH MECHANISM VIEWING TOOL

Figure 1:
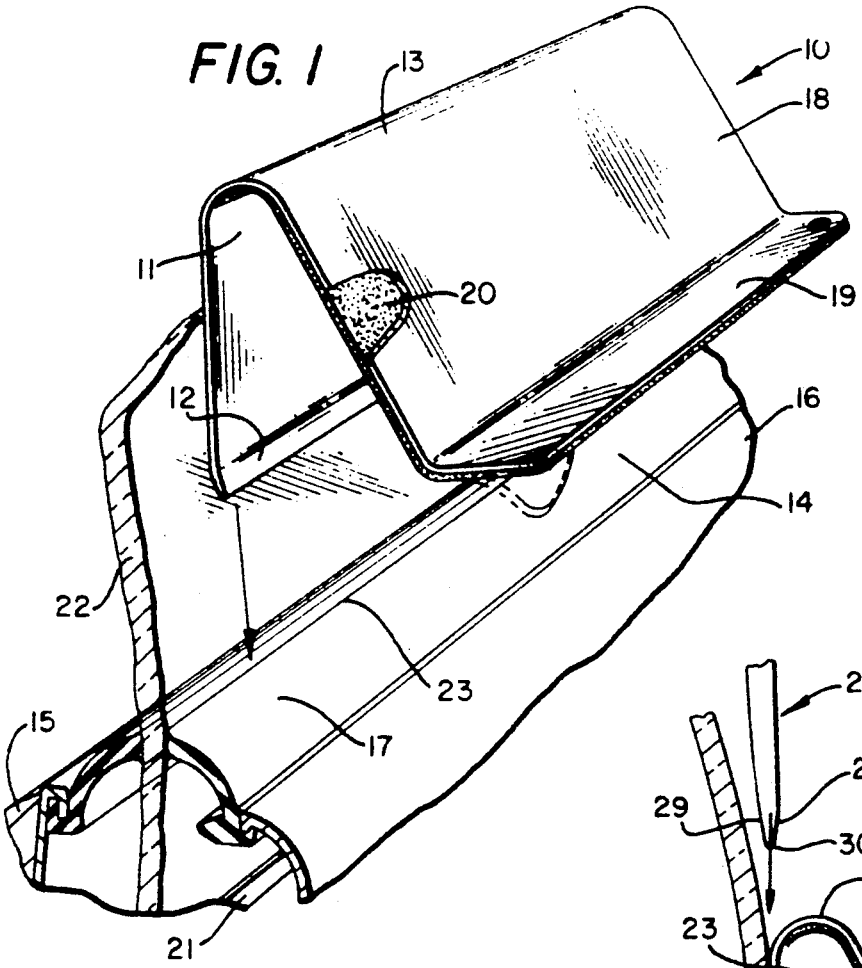

This invention relates in general to unlocking vehicle door equipment used by locksmiths, and more particularly, to a car door latch mechanism viewing and access tool.

Car owners too often lose their car door keys or at times leave them in a locked car with a locksmith being called for help in getting a locked car open again. There are many different tools that are available insertable down between the outer surface of a car door window and the outer window sill rubber seal. These include wedges pushed down therebetween, but when, for example, two wedges are used spaced from each other the rubber seal tends to resiliently form back toward its normal position obstructing vision and use of car door latch mechanism unlatching tools. Further, the resilient rubber or plastic window seal is exposed to damage from tools being inserted and, particularly, when tools are removed with hang up catching of tools on rubber outer sill sealing between spaced wedges used for seal deflection and tool access.

It is therefore a principal object of this invention to protect vehicle door outer window sill sealing from damage when tools are used to unlock a car door from the outside.

Another object is to provide a shield yielding more visual and tool access for one trying to open a locked car door from the outside.

A further object is to make unlocking a vehicle locked door, when the door key is not available, easier than herebefore.

Still another object is to provide a tool enabling a locksmith to open a locked vehicle door without a door key quicker than herebefore.

Features of the invention useful in accomplishing the above objects include, in a car door latch mechanism viewing and access tool, a relatively thin bend formed shim tool formed of sheet metal, or plastic, that is provided to help a locksmith view and have access to lock release mechanism of a locked vehicle door from the outside when the vehicle door key is lost, or left inside the vehicle. The tool insert sheet portion is inserted downwardly between the outer surface of the door window glass and the outer window sill rubber seal to hold the rubber seal deflected back out of the way when two wedges are pushed down between the door window glass and the tool insert sheet at opposite ends thereof. The tool has a curved back bottom edge at the lower edge of the insert sheet portion that depends from a rounded top that spans a portion of the door outer sill rubber seal to an outer diverging outward sheet continuation to a further outwardly extended handle. The outer diverging outward sheet continuation of the tool and the outwardly extended handle are both undercoated with a layer of felt bonded by glue or plastic to the undersides thereof to protect the paint finish of the vehicle door. The curved back bottom edge of the insert sheet portion provides for clearing the cap on the bottom of the window glass and helps prevent lock opening tools from hanging up on the tool bottom edge of the tool insert sheet portion when the tools are being withdrawn from the door interior.

A specific embodiment representing what is presently regarded as the best mode of carrying out the invention is illustrated in the accompanying drawings.

Figure 4:
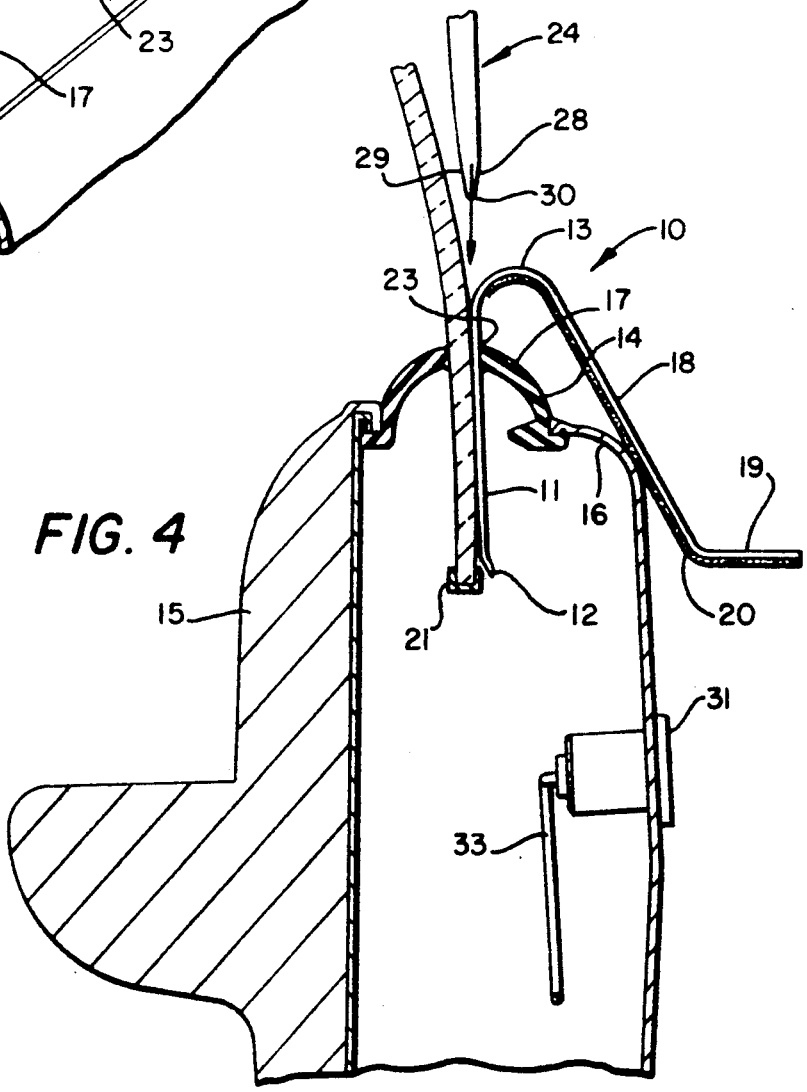
Figure 2:
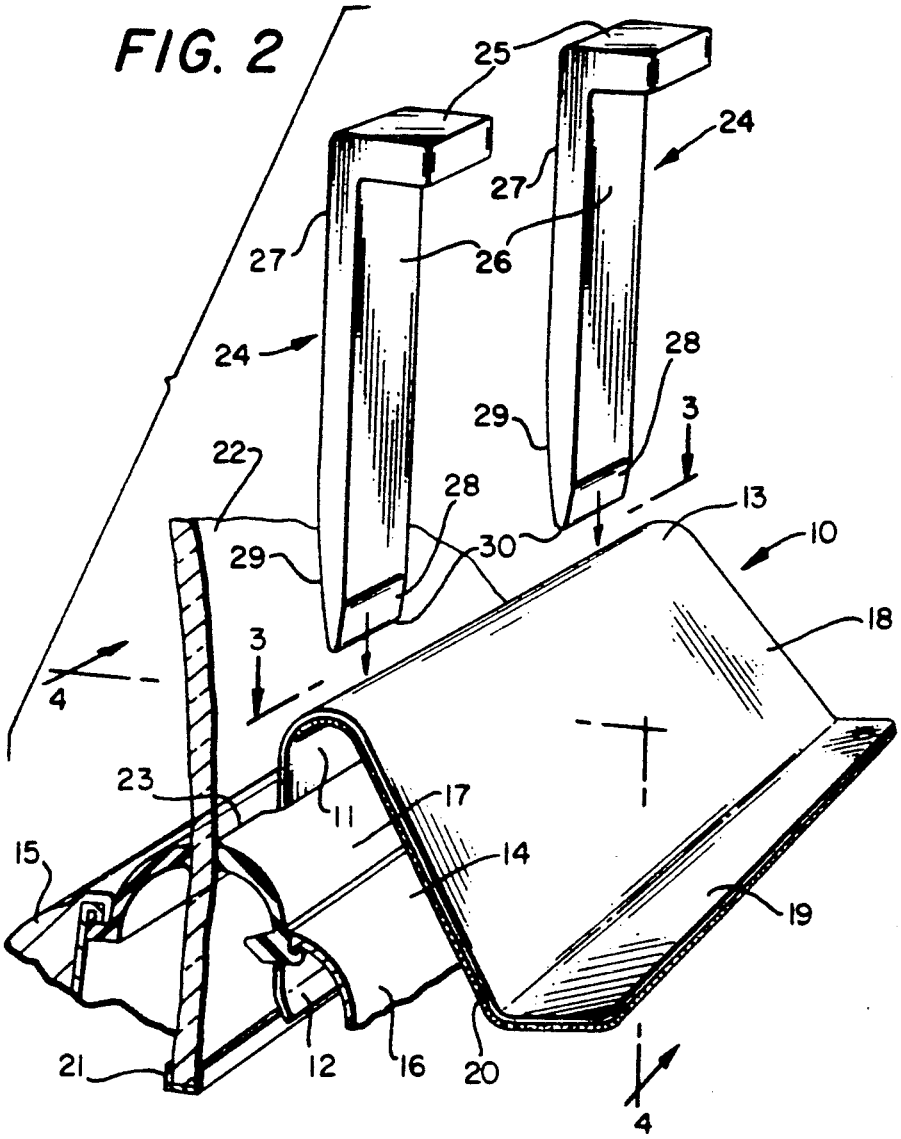
Figure 3:
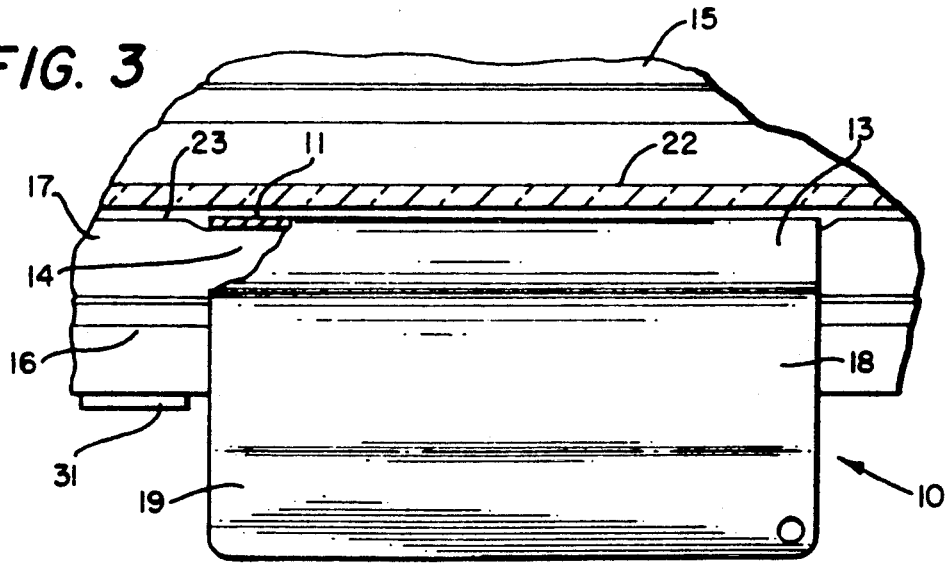
Figure 5:
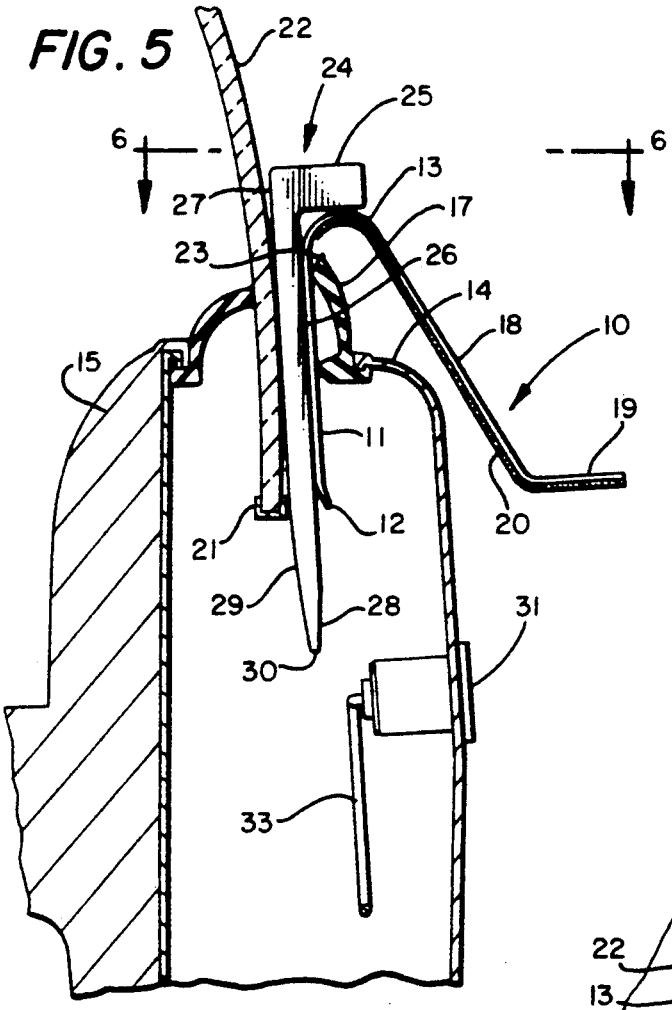
Figure 6:
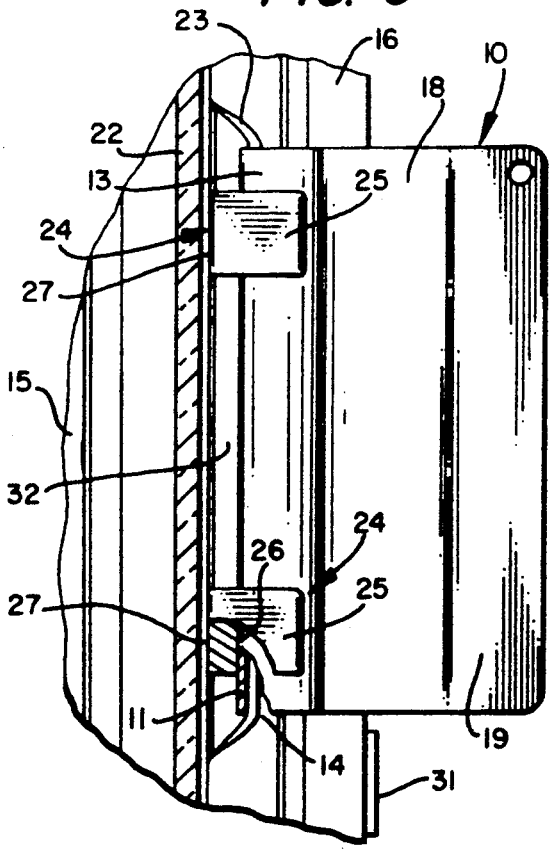

In the drawings:

FIG. 1 represents a perspective view of the car door latch mechanism viewing and access tool in position for insertion of the tool insert sheet portion downwardly between the outer surface of the door window glass and the outer window sill rubber seal;

FIG. 2, a perspective view of the tool with the insert sheet portion thereof inserted in place and with two spaced wedges in position to be inserted between the tool and the window glass;

FIG. 3, a partially broken away and sectioned top plan view of the tool in place taken from line 3—3 of FIG. 2;

FIG. 4, a cut away and sectioned side elevation view of the tool inserted in place in a car door between the outside of the door window glass and the outside sill window seal taken from line 4—4 of FIG. 2;

FIG. 5, a cut away and sectioned view like FIG. 4 with the two spaced wedges positioned down in place separating the tool insert sheet portion from the outside of the door window glass by the thickness of the inserted wedges; and, FIG. 6, a partial top plan view like FIG. 3, with the two wedges inserted in place and an opening between the tool insert sheet portion and the outside of the door window glass for viewing and tool access to lock release mechanism of a locked vehicle door from the outside.

Referring to the drawings:

The car door latch mechanism viewing and access tool 10 of FIGS. 1-6 is shown to be a shim tool formed of sheet metal, or molded plastic, having a tool sheet portion 11 generally in elongate rectangular form having a bent back bottom lower edge portion 12. The transversly extended elongate rectangular tool sheet portion 11 depends from a transversly side to side extended rounded top 13 that spans a transverse section 14 of the door 15 outer sill 16 rubber seal 17, and extends to outer slanted downward depending panel 18 terminating at the bottom in outwardly extended handle 19 with both panel 18 and handle 19, transversly, extending the length of tool 10. The underside of rounded top 13, slanted downward depending panel 18 and outwardly extended handle 19 are, all three, undercoated with a layer of felt 20 bonded by glue or plastic thereto to protect the paint finish of the vehicle door 15. When the tool 10 is lowered from the ready to insert state of FIG. 1 to the fully inserted state of FIGS. 2, 3 and 4 the layer of felt 20 under slanted downward depending panel 18 is brought into lowered position limiting contact registry with door window sill 16. The curved back bottom edge 12 of the tool sheet input portion 11 is provided to clear and not become hung up on the cap 21 on the bottom of a door window glass 22 as the tool 10 and the input portion 11 is inserted between the door window glass 22 and flexible rubber (or plastic) outer seal 17 with insert movement thereof to the lowermost inserted state of FIG. 4. In this state there is clearance under rounded top 13 of tool 10 to allow for upper movement of the upper end 23 of outer seal 17 as the tool 10 and its input portion 11 is moved outwardly from adjacency with the window glass 22 as two wedge members 24 in mutually spaced relation are pushed down between window glass 22 and the input portion 11 of tool 10.

The two wedge members 24 are duplicates one of the other and from an "L" oriented manual head 25 have spaced parallel front and back sides 26 and 27 having sloped entry surfaces 28 and 29, respectively, down to a relatively narrow bottom entry edge 30. When the two wedge members 24 are fully inserted as shown in FIG. 5 with "L" oriented manual heads 25 down in engagement with the rounded top 13 of tool 10, and with wedge members 24 in spaced relation as shown in FIGS. 2 and 6 a viewing and tool access space 32 is provided for the person working to unlock the vehicle door 15 lock 31. With the tool 10 the wedges 24 never touch the seal 17, and the rubber door glass seal 17 upper edge end 23 and the door glass frame to be wedged apart providing opening 32 between the wedges 24, the glass 22 and tool insert portion 11 as shown in FIG. 6.

By way of reiteration the tool 10 is to help locksmiths open automobiles where the automobile owner has either locked the keys in the automobile or has lost them. A few years ago most automobiles could be opened with a simple coat hanger or a tool called a "Slim Jim". In efforts to prevent easy theft, most of the late model cars require considerable knowledge with respect to the various models of automobiles and many special lock release tools are required. The heretofore customary method of recent model automobiles is to use two tapered entry wedges to hold the rubber (or flexible plastic) window weather seal back and the door window glass back so the locksmith, using a slim door light (three sixteenths inch diameter), can see through the opening and locking cams and/or rods 33 inside the automobile door. With streamlining of late model automobiles the rubber seal around the door windows fit much tighter than with earlier models and are hard to hold back with wedges alone. With these newer model cars it is many times nearly impossible to wedge open a space large enough to see and to permit working with special lock release tools inside the automobile door. Further, many of the resilient rubber weather seals are so elastic and tight that two wedges will no longer hold the seal back between the wedges interferring with the locksmith's work between the wedges. Another problem with wedges alone is that they can cut rubber window seals when they are pushed in with this being especially true with automobiles that are older and where the rubber seal has weathered. With this new tool 10 the wedges 24 never touch the rubber seals since a portion of the tool 10 is slipped between door window glass 22 and the outer door window rubber seal. Wedges 24 are inserted between door window glass 22 and the tool 10. This allows the rubber door window glass seal and the door glass window glass frame to be wedged open without damage to the rubber window glass seal, and holds all seal rubber out of the way the full distance between the two wedges 24.

Whereas this invention has been described with respect to a single embodiment thereof it should be realized that various changes may be made without departure from the essential contributions to the art made by the teachings hereof.

I claim:

1. A vehicle door lock latch mechanism viewing and access tool comprising: a relatively thin material formed shim tool and two wedges used together with the shim tool; said shim tool having a generally rectangular tool insert sheet portion transversly longer from side edge to side edge than its vertical extent insertable downwardly between an outer surface of a door window glass and an outer window sill rubber seal to hold the rubber seal deflected back out of the way when said two wedges, in spaced relation are pushed down between the door window glass and the tool insert sheet adjacent opposite ends thereof; said tool insert sheet portion extended at the top into a rounded top spanning a portion of the door outer sill rubber seal when the tool is inserted in place; an outer downwardly diverging angled generally rectangular sheet continuation from said rounded top; and a layer of soft material bonded to the underside of said outer downwardly diverging angled generally rectangular sheet to protect finish of the vehicle door.

2. The vehicle door lock latch mechanism viewing and access tool of claim 1, wherein said tool has a curved back bottom edge at the lower edge of said generally rectangular tool insert sheet portion.

3. The vehicle door lock latch mechanism viewing and access tool of claim 1, wherein an outwardly extended handle is provided extending outwardly from the bottom of said downwardly diverging angled generally rectangular sheet.

4. The vehicle door lock latch mechanism viewing and access tool of claim 3, wherein said layer of soft material bonded to the underside of said outer downwardly diverging angled generally rectangular sheet is a cloth material.

5. The vehicle door lock latch mechanism viewing and access tool of claim 4, wherein said cloth material is a layer of felt bonded in place by a glue material.

6. The vehicle door lock latch mechanism viewing and access tool of claim 3, wherein said layer of soft material is extended to underlie and be bonded to the underside of said outwardly extended handle.

7. The vehicle door lock latch mechanism viewing and access tool of claim 6, wherein said layer of soft material is extended to underlie and be bonded to the underside of said rounded top.

8 The vehicle door lock latch mechanism viewing and access tool of claim 3, wherein said layer of soft material is extended to underlie and be bonded to the underside of said rounded top.

9. The vehicle door lock latch mechanism viewing and access tool of claim 1, wherein said downwardly diverging angled generally rectangular sheet continuation from said rounded top is positioned for its underside to engage the door window sill as said insertion lowered position insert sheet portion is in it's limiting contact with the door window sill.

10. The vehicle door lock latch mechanism viewing and access tool of claim 9, wherein with the insert sheet portion in the insertion lowered position limiting contact with the door window sill there is clearance under said rounded top of the tool to allow for upper movement of the upper end of the outer seal as the tool insert sheet portion is inserted to its fully inserted limit state and with said two wedges inserted in place.

11. The vehicle door lock latch mechanism viewing and access tool of claim 10, wherein said layer of soft material bonded to the underside of said outer downwardly diverging angled generally rectangular sheet is a cloth material.

12. The vehicle door lock latch mechanism viewing and access tool of claim 11, wherein said cloth material is a layer of felt bonded in place by a glue material.

13. The vehicle door lock latch mechanism viewing and access tool of claim 10, wherein said layer of soft material is extended to underlie and be bonded to the underside of said outwardly extended handle.

14. The vehicle door lock latch mechanism viewing and access tool of claim 13, wherein said layer of soft material is extended to underlie and be bonded to the underside of said rounded top.

15. The vehicle door lock latch mechanism viewing and access tool of claim 10, wherein said layer of soft material is extended to underlie and be bonded to the underside of said rounded top.

16. The vehicle door lock latch mechanism viewing and access tool of claim 10, wherein said tool has a curved back bottom edge at the lower edge of said generally rectangular tool insert sheet portion.

17. The vehicle door lock latch mechanism viewing and access tool of claim 1, wherein said tool is form bent from sheet metal.

18. The vehicle door lock latch mechanism viewing and access tool of claim 1, wherein said tool is mold formed from a plastic material.

19. A vehicle door lock latch mechanism viewing and access tool comprising: a relatively thin material formed shim tool and two wedges used together with the shim tool; said shim tool having a generally rectangular tool insert sheet portion transversly longer from side edge to side edge than its vertical extent insertable downwardly between an outer surface of a door window glass and an outer window sill rubber seal to hold the rubber seal deflected back out of the way when said two wedges, in spaced relation are pushed down between the door window glass and the tool insert sheet adjacent opposite ends thereof; said tool insert sheet portion extended at the top into a rounded top spanning a portion of the door outer sill rubber seal when the tool is inserted in place; and an outwardly extended generally recatngular sheet continuation from said rouned top.

* * * * *